United States Patent [19]

Valis

[11] Patent Number: 4,943,695

[45] Date of Patent: Jul. 24, 1990

[54] METHOD OF AND APPARATUS FOR PROTECTING A PUSH BUTTON ON A NEWSPAPER VENDING MACHINE

[75] Inventor: Johnnie J. Valis, Shiner, Tex.

[73] Assignee: Gannett Co., Inc., Arlington, Va.

[21] Appl. No.: 141,083

[22] Filed: Jan. 5, 1988

[51] Int. Cl.[5] ..... H01H 13/00

[52] U.S. Cl. ..... 200/345; 194/350

[58] Field of Search ..... 194/345, 346, 233, 350; 221/152; 222/153, 182, 402.11, 402.13; 200/43.13, 340, 334, 43.01, 338, 341, 345

[56] References Cited

U.S. PATENT DOCUMENTS

| | | | |
|---|---|---|---|
| 49,000 | 7/1865 | Pomeroy | 70/453 |
| 516,086 | 3/1894 | Easley | 70/454 |
| 631,892 | 8/1899 | Johnson | 200/345 |
| 676,450 | 6/1901 | Schwartz | 70/454 |
| 1,088,237 | 2/1914 | Mulford | 70/454 |
| 1,656,952 | 1/1928 | Nutt | 200/345 |
| 1,672,901 | 6/1928 | North | 292/271 |
| 1,784,935 | 12/1930 | Johnson | 292/221 |
| 1,987,571 | 1/1935 | Hardage | 200/334 X |
| 2,036,541 | 4/1936 | Ringseis | 70/454 |
| 2,708,845 | 5/1955 | Trammell, Jr. . | |
| 2,726,889 | 12/1955 | Lawson . | |
| 2,804,329 | 8/1957 | Landis . | |
| 2,942,452 | 6/1960 | Marchese | 70/454 |
| 3,247,691 | 4/1966 | Martin | 70/181 |
| 3,623,758 | 11/1971 | Trinca | 292/347 |
| 3,691,985 | 9/1972 | Otterlei | 116/124 |
| 3,746,818 | 7/1973 | Bertelloti | 200/168 |
| 3,774,742 | 11/1973 | Magnanelli | 194/1 |
| 3,786,968 | 1/1974 | Ewald | 221/152 |
| 3,915,485 | 10/1975 | Richman et al. | 292/347 |
| 3,999,788 | 12/1976 | Livingston | 292/1 |
| 4,018,100 | 4/1977 | Moe | 74/483 PB |
| 4,037,701 | 7/1977 | Knickerbocker | 194/227 |
| 4,084,414 | 4/1978 | Martin | 292/347 |
| 4,098,529 | 7/1978 | Bingham | 292/347 |
| 4,160,136 | 7/1979 | McGough | 179/184 |
| 4,177,363 | 12/1979 | Keranen | 200/5 B |
| 4,570,826 | 2/1986 | Fattori | 222/83 |
| 4,614,846 | 9/1986 | Guercio et al. | 200/5 E |
| 4,620,646 | 11/1986 | Crapser | 222/153 |

FOREIGN PATENT DOCUMENTS

| | | | |
|---|---|---|---|
| 3021857 | 12/1981 | Fed. Rep. of Germany | 200/345 |

*Primary Examiner*—Joseph J. Rolla
*Assistant Examiner*—Boris Milef
*Attorney, Agent, or Firm*—Burns, Doane, Swecker & Mathis

[57] ABSTRACT

A push button guard for a push button which protrudes from the front face of a newspaper vending machine, for protecting the push button against destructively violent actuation. The guard defines a cavity into which the push button protrudes from the base. A newspaper vending machine including such a guard, and a method of protecting a push button using such a guard, are also disclosed and claimed.

3 Claims, 1 Drawing Sheet

FIG. 1
(PRIOR ART)
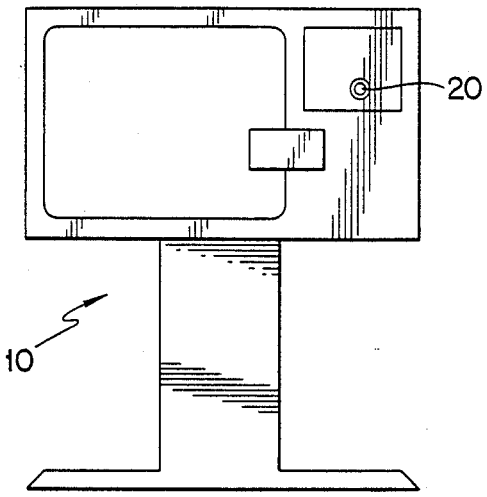
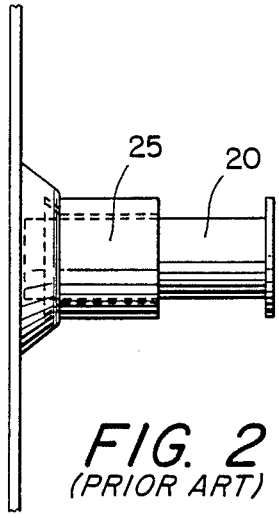
FIG. 2
(PRIOR ART)
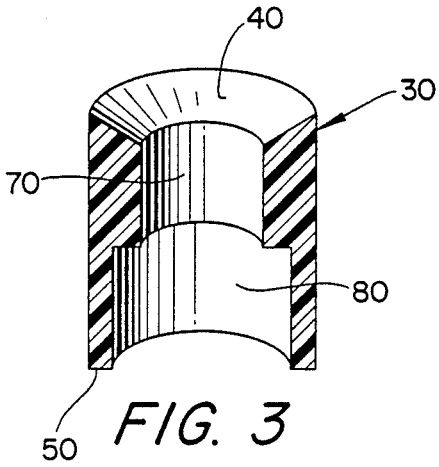
FIG. 3
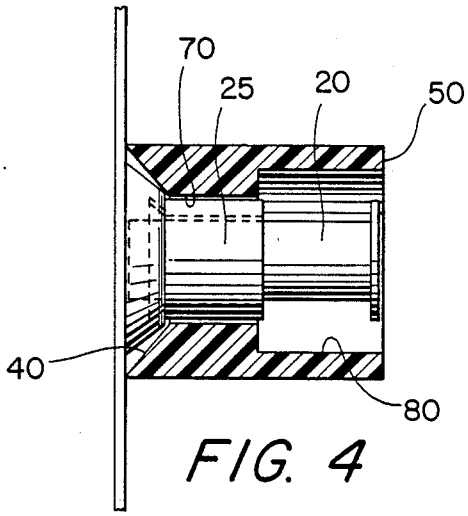
FIG. 4

METHOD OF AND APPARATUS FOR PROTECTING A PUSH BUTTON ON A NEWSPAPER VENDING MACHINE

BACKGROUND OF THE INVENTION

1. Field of Invention

This invention relates to the field of push button actuated mechanisms on newspaper vending machines, and, specifically, to a method of and apparatus for preventing the push button from moving so quickly or with so much force as to damage the mechanism.

2. Background Art

Newspaper vending machines, also known as coin-operated newsracks, have become a common sight in locations subjected to heavy pedestrian traffic, such as street corners. In fact, it seems usual that every street corner has several newsracks, making available to the public various newspapers and other periodicals without the intermediation of a human vendor. Yet, while newsracks are common, it may not be often appreciated that the design of a successful newsrack poses a set of uniquely challenging engineering problems, arising primarily from exposure to winter weather, salt, snowplows, and vandals.

Not the least of the problems alluded to above is that newsracks are prone to vandalism. Several factors contribute to this vunerability. The first is that the newsracks are unattended twenty-four hours each day, including the night hours when the vandal is not inhibited by the attention of others. Second, the newsracks may be thought to contain coins accumulated over the course of the day. Third, even people not normally prone to vandalism may be inclined to strike the machine or treat it roughly if the machine malfunctions.

This third reason may account for the fact that one particularly vulnerable component is the coin-release mechanism. As shown in FIG. 1, this mechanism is typically actuated by a push button such as push button 20 protruding from the front face of the newsrack, designated by numeral 10. The push button protrudes a predetermined distance out from the front face. A bushing or sleeve 25 is also provided in some known configurations to protect the push button over at least part of its length. The bushing may flare toward its base, as shown in FIG. 2.

The mechanism is arranged so that it can be actuated by pushing the button a predetermined distance by the pressure exertable by a patron's thumb or forefinger. It often happens, however, that people attempt to actuate the button with a considerably greater amount of force, sometimes using the palm of their hands or even their feet to drive the button inward. It has also happened that the newsrack is tipped over on its face, which can also drive the button inward. This can cause serious damage to the coin-return mechanism because the button may travel too fast or with too much force, caving in the main channel of the coin-return mechanism. Given the large number of such machines in use, one can easily see that damage caused by violent actuation of the coin-release mechanism can quickly add up to considerable sums of money.

There is therefore a need to prevent violent actuation of push-button actuated devices on newsracks. At the same time, it is necessary that any device used for such protection be easy to fabricate and relatively inexpensive. It would also be advantageous if the device could be added after the newsrack is substantially completely assembled, so that newsracks already in use could be retrofitted.

SUMMARY OF THE INVENTION

The need presently experienced is met in the context of the present invention through the provision of a guard which is mountable on the front face of the newsrack around the push button. An inside face of the guard is adapted to be mountable on the front face of the newsrack, preferably using existing structure around the button. The guard is also provided with a bore which has a diameter great enough to accommodate the head of the push button. This makes it easy to attach the guard after fabrication of the newspaper vending machine. The bore is stepped so that the push button protrudes out of a narrower portion of the bore and into a cavity defined by a wider portion of the bore adjacent the outer or front face of the guard. The depth of the cavity is not substantially less than the amount by which the button protrudes into the cavity. The result of this arrangement is that the button is protected from blows delivered by an object which cannot fit in the cavity. In fact, the button can be so well shielded that it can not as a practical matter be actuated except in the manner intended.

BRIEF DESCRIPTION OF THE DRAWINGS

These and other features and advantages of the invention will be more clearly understood from the following description read in conjunction with the drawings, in which:

FIG. 1 is a diagram of a customary configuration of a newspaper vending machine having a push-button actuated mechanism;

FIG. 2 is a side view of a push button for actuating a mechanism contained in the newsrack, such as a coin-release mechanism;

FIG. 3 is a cut-away view of an embodiment of a push button guard according to the present invention; and FIG. 4 is a side cut-away view of the push button guard of FIG. 3 as it would be used to protect a push button such as that shown in FIG. 2.

DETAILED DESCRIPTION OF THE PREFERRED EMBODIMENTS

An embodiment of a push button guard according to the present invention is shown in FIG. 3. The guard has a body 30 having an inner or inside face 40 and and outer or outside face 50. The inner face 40 communicates with the outer face 50 through a bore having a first channel or bore section 70 and a second channel or bore section 80. (Bore is used in this specification with appended claims to mean any lengthwise cavity, regardless of whether it is cylindrical and regardless of whether made by or as if by boring).

The inner face 40 with first bore section 70 are adapted to be attachable to the outside surface of newsrack 10 around push button bushing 25. In the embodiment of FIG. 3, this is accomplished by providing an inner face 40 with a tapered configuration and selecting the diameter of first bore section 70 to provide a snug fit for bushing 25. The taper permits the guard to abut the front face of the newspaper vending machine without hindrance from any structure on the base of bushing 25. This arrangement is shown in FIG. 4. It will be apparent to one of ordinary skill in the art, however, that other means may be used for attaching the guard about the push button.

The bore of first bore section 70 is selected to be great enough to permit passage therethrough of the widest portion of the push button, which is normally its head. The total length of the first bore 70 and the lateral extent of inner face 40 is selected to be less than the distance by which the push button protrudes from the front surface of the newspaper vending machine. Thus, the button protrudes out of first bore section 70 and into a cavity formed by a second bore section 80.

The cavity is provided to permit the push button to be depressed in a manner contemplated by its designer, but, at the same time to prevent it from being actuated violently by a blow from hand or foot. The distance by which the button protrudes into the cavity is selected with several considerations in mind. A lesser amount of protrusion enhances the degree of protection which the guard affords the button. On the other hand, the protrusion should not be so slight that it becomes difficult to actuate the mechanism. The depth of the cavity is ideally chosen to be just slightly greater than the distance by which the button protrudes into the cavity. This puts the head of the push button at a position slightly recessed from a position flush with the outer edge 50 of the cavity. Of course, it will be apparent to one of ordinary skill in the art that this is not an absolute condition, and some variation from it will still yield a device which produces satisfactory results. The button should not, however, protrude too far from the cavity or else the guard will have reduced shielding effect.

To discuss an embodiment of the invention in more concrete dimensions, a typical newsrack may include a coin-release button which protrudes from the front of the rack by a distance of just under approximately 1.625 inches. The head on a push button may have a diameter of about 0.625 inches. There may also be a protective bushing concentric with the button and having a diameter of approximately 0.75 inches and which protrudes from the front of the newsrack by about 0.875 inches. A concentric flange may form part of the base of the bushing, and may have a diameter of approximately 1.187 inches and a height off of the surface of the newsrack of about 0.250 inches.

A preferred embodiment of a push-button guard according to the present invention for such a push button would have an outer diameter of about 1.5 inches. The first bore section would have a diameter of about just over 0.75 inches and the second bore section would have a diameter of about 1.187 inches. The length of the first bore section would be in the range of about 0.521 to 0.531 inches and the length of the second bore section would be about 0.812 inches. The lateral extent of the taper on the inner face 40 would be in the range of about 0.281 to 0.291 inches. The total length of the body would be about 1.625 inches.

A preferred material for construction of the pushbutton guard body must be durable yet inexpensive and easily machined. The presently preferred material is an acetal resin such as Delrin® brand acetal resin available from E.I. duPont de Nemours & Co. It will be obvious to one of ordinary skill in the art, however, that other materials could be used.

As alluded to above, the guard, besides being easily fabricated, has the additional advantage that its configuration permits its placement on a newspaper vending machine already substantially assembled. This means not only that the manufacturing operation need not be altered substantially, but also that newspaper vending machines already deployed and in use may be retrofitted with guards according to the present invention The possibility that protection against very costly damage may be realized so simply and inexpensively is a considerable advantage achievable only through the present invention.

The invention has been described above with an axially symmetric, substantially cylindrical body. This configuration has the advantage that it is easy to fabricate. It is not strictly necessary, however, that the body have this configuration, and the body could have other configurations depending on the particular utilitarian and aesthetic demands of given application. It will be understood by one of ordinary skill in the art that the present invention encompasses such variations within its scope.

What is claimed is:

1. A vending machine comprising:

a push button protruding a first distance from an outer surface of the vending machine and adapted to actuate a mechanism such as a coin-release mechanism when depressed;

a bushing arranged around a base of the push button; and a push button guard being defined by a body, said body including an inner face at one end of the body and an outer face at an opposite end of the body, said inner face communicating with said outer face through a stepped bore that extends through the body, said stepped bore including a narrower portion and a wider portion, said narrower portion being adapted to tightly surround the bushing and said narrower portion having a length as measured along its longitudinal axis that is less than said first distance so that when said narrower portion of said body is positioned around said bushing, the push button extends through the narrower portion of the stepped bore and into the wider portion of the stepped bore.

2. The vending machine according to claim 1, wherein said narrower portion is located adjacent said inner face and said wider portion is located adjacent said outer face, said inner face tapering inwardly toward said narrower portion to define a truncated conical configuration.

3. A method of protecting a push button protruding a first distance from an outer surface of a vending machine and adapted to actuate a mechanism such as a coin-release mechanism when depressed comprising the step of attaching a guard to a bushing that surrounds the push button, said guard having a stepped bore that extends through the guard to define a narrower bore portion and a wider bore portion, said narrower bore portion being adapted to tightly surround the bushing so that said push button extends through said narrower bore portion and into said wider bore portion without extending substantially beyond an outer face of the guard.

* * * * *